US010253271B2

(12) United States Patent
Klein et al.

(10) Patent No.: US 10,253,271 B2
(45) **Date of Patent: *Apr. 9, 2019**

(54) SYSTEMS AND METHODS FOR REFINING CORROSIVE CRUDES

(71) Applicant: Bechtel Hydrocarbon Technology Solutions, Inc., Houston, TX (US)

(72) Inventors: Benjamin Klein, Houston, TX (US); Odette Eng, Sugar Land, TX (US)

(73) Assignee: Bechtel Hydrocarbon Technology Solutions, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/877,915

(22) Filed: Jan. 23, 2018

(65) Prior Publication Data

US 2018/0187098 A1 Jul. 5, 2018

Related U.S. Application Data

(60) Continuation of application No. 14/501,516, filed on Sep. 30, 2014, now Pat. No. 9,909,075, which is a division of application No. 13/447,957, filed on Apr. 16, 2012, now Pat. No. 9,920,263.

(60) Provisional application No. 61/475,519, filed on Apr. 14, 2011.

(51) Int. Cl.

| | |
|---|---|
| ***C10G 55/04*** | (2006.01) |
| ***C10G 7/06*** | (2006.01) |
| ***C10G 7/12*** | (2006.01) |
| ***C10G 7/00*** | (2006.01) |
| ***C10G 9/00*** | (2006.01) |
| ***C10G 7/02*** | (2006.01) |

(52) U.S. Cl.

CPC ..... *C10G 55/04* (2013.01); *C10G 7/00* (2013.01); *C10G 7/02* (2013.01); *C10G 7/06* (2013.01); *C10G 7/12* (2013.01); *C10G 9/005* (2013.01); *C10G 2300/1033* (2013.01); *C10G 2300/1077* (2013.01); *C10G 2300/301* (2013.01); *C10G 2400/02* (2013.01); *C10G 2400/04* (2013.01); *C10G 2400/06* (2013.01); *C10G 2400/08* (2013.01)

(58) Field of Classification Search

CPC . C10G 7/06; C10G 7/12; C10G 9/005; C10G 55/04

See application file for complete search history.

(56) References Cited

U.S. PATENT DOCUMENTS 3,480,540 A * 11/1969 Jackson ..... C10C 3/00 208/209
3,671,419 A * 6/1972 Ireland ..... C10G 69/00 208/57
4,797,197 A * 1/1989 Mallari ..... C10B 55/00 208/131
5,124,027 A * 6/1992 Beaton ..... C10G 67/049 208/162

* cited by examiner

*Primary Examiner* — Renee Robinson
(74) *Attorney, Agent, or Firm* — Crain Caton and James

(57) ABSTRACT

Systems and methods for refining conventional crude and heavy, corrosive, contaminant-laden carbonaceous crude (Opportunity Crude) in partially or totally separated streams or trains.

8 Claims, 3 Drawing Sheets

SYSTEMS AND METHODS FOR REFINING CORROSIVE CRUDES

CROSS-REFERENCE TO RELATED APPLICATIONS

This application is a continuation of and claims priority to U.S. patent application Ser. No. 14/501,516, filed on Sep. 30, 2014, which is a division of and claims priority to U.S. patent application Ser. No. 13/447,957, filed on Apr. 16, 2012, which claims priority from U.S. Provisional Patent Application No. 61/475,519, filed on Apr. 14, 2011, all of which are incorporated herein by reference.

STATEMENT REGARDING FEDERALLY SPONSORED RESEARCH

Not applicable.

FIELD OF THE INVENTION

The present invention generally relates to refining of corrosive crudes. More particularly, the invention relates to systems and methods for refining conventional crude and heavy, corrosive, contaminant-laden carbonaceous crude in partially separated streams or trains.

BACKGROUND OF THE INVENTION

For existing oil refineries, the high cost of conventional, light sweet, crude oils has led refiners to consider retrofits with partial replacement of conventional crude oils with price-discounted heavy, corrosive (organic acids), contaminant laden (organic metals, polar heteroatoms, etc.) carbonaceous material more commonly referred to as "Opportunity Crude", such as those offered from extensive reserves in Western Canada, Latin America, China, Russia, North Sea and elsewhere.

Many refiners have performed such retrofits by co-mingling or blending Opportunity Crude with conventional crude and requiring extensive modifications to almost every refinery process unit to deal with changes in the unit feed composition (e.g., boiling range, molecular structure, etc.) and level of contaminants (e.g., metals, sulfur, nitrogen, organic acids, etc.).

Declining markets for high sulfur fuel oil and asphalt, combined with shifting to heavier feedstock materials, have resulted in the need for heavy residual oil upgrading technologies, such as delayed coking, to reduce the yield of high sulfur fuel oil/asphalt and increase the yield of products in the range of liquid transportation fuels.

The combination of extensive retrofit costs and inefficient application of heavy residual oil upgrading often leads to an extremely high project capital cost, which may not justify the investment decision to introduce the Opportunity Crude into an existing refinery. This situation is likely to continue for an extended period of time on a worldwide basis.

A typical and conventional crude (e.g., low sulfur, low metals, low naphthenic acid, high API gravity, etc.) refining system 100 is illustrated in FIG. 1. This conventional system may be considered as a candidate for replacement of a portion of the refinery's conventional crude with a similar volume of lower quality Opportunity Crude. Many other conventional crude configurations are possible, however, which may benefit from the present invention. Thus, FIG. 1 is just one example of a conventional crude configuration that may benefit from the present invention. In order to realize the benefits of a low cost Opportunity Crude, the capital cost of equipment modifications and additions must represent an acceptable return on investment and the yield and quality of refined products must meet market demand goals and product quality specifications. Unfortunately, prior art systems have been insufficient to do so or have required extensive modifications.

In operation of a typical and conventional crude refining system, conventional crude is routed through Desalting and Preheat Units 102, a Fired Heater Unit 103 (which may be an atmospheric crude fired heater), an Atmospheric Crude Distillation Tower 104, a Fired Heater Unit 105 and a Vacuum Distillation Tower 106 to produce a number of product fractions. As all are of equal importance in the process, no single product or product fraction is generally considered the principal product, rendering the others "by-products;" however, to the extent any one product is considered the principal product, such as gasoline, the others may be considered "by-products" of the process of gasoline production and thus, the terms "product" and "byproduct" may be used synonymously herein. The Atmospheric Crude Distillation Tower 104, the Fired Heater Unit 105 and a Vacuum Distillation Tower 106 separate the conventional crude into fractions by boiling range, such that each fraction becomes a suitable feed stock for downstream conversion and treating process units.

Products separated by the Atmospheric Crude Distillation Tower 104 include light gases, light naphtha (typically $C_5$-180° F. boiling range as gasoline blend stock), and heavy naphtha (typically 180°-400° F. boiling range), which may be provided as a feed stock to the downstream Catalytic Hydrotreating and Catalytic Reforming Unit 110. Light gases are separated from naphtha in the Gas Recovery Unit 108. Products of the Gas Recovery Unit 108 include $C_3$-$C_4$ Liquefied Petroleum Gas (LPG) and refinery fuel gas, which may be burned in refinery furnaces.

Heavy naphtha undergoes contaminant sulfur/nitrogen removal and molecular rearrangement to increase gasoline octane in the Catalytic Hydrotreating and Catalytic Reforming Unit 110. Reformed heavy naphtha becomes a gasoline blend stock.

Another product of the Atmospheric Crude Distillation Tower 104 is kerosene. Kerosene (typically 380°-550° F. boiling range) is drawn from the Atmospheric Crude Distillation Tower 104 and routed to Kerosene Treating Unit 112. Treated kerosene (e.g., low mercaptan sulfur, high smoke point, etc.) may be sold as commercial kerosene or, with suitable freeze point, aromatics concentration, gum, and flash point, as jet engine fuel.

Another product of the Atmospheric Crude Distillation Tower 104 is diesel. Diesel (typically 500°-680° F. boiling range) is drawn from the Atmospheric Crude Distillation Tower 104 and routed to the Diesel Hydrotreating Unit 114. Catalytic hydrotreating reduces sulfur content to meet ultra low sulfur diesel specifications for on-road transportation fuel service.

Heavy atmospheric gas oil (typically 650°-750° F. boiling range) is drawn from the Atmospheric Crude Distillation Tower 104 and routed to the Fluidized Catalytic Cracking Unit 116.

High boiling (typically, 650° F. and higher) atmospheric residue from the bottom of the Atmospheric Crude Distillation Tower 104 flows through the Fired Heater Unit 105 and the Vacuum Distillation Tower 106.

Products of the Vacuum Distillation Tower 106 are vacuum gas oils (typically 625°-1,000° F. boiling range), which are provided as a feed stock to the Fluidized Catalytic Cracking Unit 116, and vacuum residue (typically 1000°+ F.), which may be used as high sulfur fuel oil or asphalt.

Vacuum gas oils are routed to the Fluidized Catalytic Cracking Unit 116, which may or may not include a catalytic hydrotreating pre-treatment step. In the fluidized catalytic cracking process, higher boiling vacuum gas oils are cracked into more valuable diesel and gasoline boiling range products. Byproduct LPG and fuel gas are recovered and separated within the Fluidized Catalytic Cracking Unit 116. The diesel product becomes a feed stock to the Diesel Hydrotreating Unit 114, while the gasoline product is routed to the Gasoline Hydrotreating Unit 118 for sulfur removal to meet specifications for low sulfur gasoline.

The most common prior art configuration and technical basis for replacing a portion of the refinery's conventional crude with a similar volume of lower quality Opportunity Crude is illustrated in FIG. 2, an exemplary prior art process 200, particularly for purposes of comparison.

In FIG. 2, conventional crude and Opportunity Crude compose a blended feed stock referred to as "Opportunity Crude Blend" for this system 200 rather than using only conventional crude. Conventional crude and especially Opportunity Crude contain salts, sand, clay and sediments that could foul exchangers and certain material can poison downstream catalysts. Salts are frequently present in the form of Calcium, Sodium and Magnesium Chlorides. The high temperatures that occur downstream in the system 200 could allow the formation of corrosive hydrochloric acid. Therefore, the first step is to feed the Opportunity Crude Blend through a desalter where salts, suspended solids and free water are removed at low temperatures before this feed stock is preheated in a series of heat exchangers and a fired heater. Having a higher proportion of Opportunity Crude in the Opportunity Crude Blend will raise the specific gravity, lower the API gravity, and increase the viscosity and salt content of the material passing through the Desalting and Preheat Units 202. These factors will make desalting more difficult, resulting in the need for more desalting capacity to increase residence time and facilitate oil/water separation, along with higher operating temperature and pressure, to suppress vaporization. As the operating conditions of the Desalting and Preheat Units 202 will also become inadequate for the new function, a replacement desalter, capable of higher temperatures and with a higher mechanical design pressure must be considered.

A Fired Heater Unit 203 associated with the Atmospheric Crude Distillation Tower 204 may be used to heat up the Opportunity Crude Blend to a desired temperature (between 650°-700° F. depending on the type of feed stock) before it enters an Atmospheric Crude Distillation Tower 204. Opportunity Crude with high Total Acid Number ("TAN") (particularly high naphthenic acid content) are corrosive, particularly in the temperature range between 450°-700° F., wherein the naphthenic acids are concentrated. The preheat exchangers piping and surface areas as well as the furnace tube metallurgy operating in this temperature range therefore, must be upgraded in the Atmospheric Crude Distillation Tower 204.

The Opportunity Crude Blend is flashed off in the Atmospheric Crude Distillation Tower 204, which uses pump-around cooling loops to create an internal liquid reflux. Product draws are on the top, sides, and bottom. The Atmospheric Crude Distillation Tower 204 operates on a descending temperature profile from bottom up as reflux from the top of the Atmospheric Crude Distillation Tower 204 provides the cooling medium while the Fired Heater Unit 203 in the bottom of the Atmospheric Crude Distillation Tower 204 provides heat to boil up product distillates. From the top of the Atmospheric Crude Distillation Tower 204, at any point where the temperature may exceed 450° F., column trays and their internals must be replaced with higher metallurgy material. Since the bottom portion of the Atmospheric Crude Distillation Tower 204 would be operating at higher temperatures (between 650°-700° F. depending on the type of feed stock) and exposed high TAN corrosive attacks, the lower shell of the Atmospheric Crude Distillation Tower 204 may be insufficient absent some modification, to provide alloy lining or a weld overlay.

The reduced crude exiting the bottom of the Atmospheric Crude Distillation Tower 204 is heated in a Fired Heater Unit 205 before being routed to the and the Vacuum Distillation Tower 206 to recover any gas oil from the reduced crude. Product draws are on the top, sides, and bottom. The Vacuum Distillation Tower 206 operates on a descending temperature profile from bottom up as reflux from the top of the Vacuum Distillation Tower 206 provides the cooling medium while a Fired Heater Unit 205 in the bottom of the Vacuum Distillation Tower 206 provides heat to boil up product vacuum gas oils.

Light products from the top of the Atmospheric Crude Distillation Tower 204 are sent to a Gas Recovery Unit 208 to separate fuel gas from LPG.

Full range naphtha recovered from the Atmospheric Crude Distillation Tower 204 is separated into light and heavy fractions. Light naphtha is sent for gasoline blending while heavy naphtha is processed through a Catalytic Hydrotreating and Catalytic Reforming Unit 210 to become a high octane gasoline component.

A kerosene product from the Atmospheric Crude Distillation Tower 204 is sent to a Kerosene Treating Unit 212 to remove sulfur and mercaptans. To produce jet fuel, a certain level of aromatic saturation needs to take place in order to make the smoke point specifications of jet fuel material.

A diesel product from the Atmospheric Crude Distillation Tower 204 and light gas oil from the Delayed Coker Unit 220 are combined and hydrotreated in a Diesel Hydrotreating Unit 214 to remove sulfur. In this process, the operating conditions and catalyst space velocity are selected in order to ensure both sulfur removal and a high cetane index number to meet the required specifications for Ultra Low Sulfur Diesel. These units may need to be modified from a conventional design using techniques well known in the art to manage the higher feed rates as conventional diesel hydrotreating unit reactors are not of sufficient size to address the higher feed rates and higher operating temperatures.

Atmospheric gas oil from the Atmospheric Crude Distillation Tower 204, vacuum gas oil from the Vacuum Distillation Tower 206 and heavy gas oil from the Delayed Coker Unit 220 pass through a Fluidized Catalytic Cracking Unit 216 to be further converted to lighter products. These products range from LPG, naphtha, LCO and slurry oil. With the use of Opportunity Crude, feeds to the Fluidized Catalytic Cracking Unit 216 are expected to contain higher level of contaminant requiring a higher catalyst replacement rate.

A gasoline product from the Fluidized Catalytic Cracking Unit 216 is routed to the Gasoline Hydrotreating Unit 218 to remove sulfur down to 30 or 10 ppm with minimum octane loss.

A vacuum resid from the bottom of the Vacuum Distillation Tower 206 is sent to the Delayed Coking Unit 220, which also includes gas recovery and naphtha hydrotreating units, in order to convert this resid material to lighter products, such as light gas oil and heavy gas oil while minimizing LPG production.

Various other modifications have explored replacing a portion of the refinery's conventional crude with a similar volume of lower quality Opportunity Crude such as, for example, that disclosed in U.S. Patent Application Publication No. 2010/0206773 A1, U.S. Patent Application Publication No. 2010/0206772 A1, and U.S. Patent Application Publication No. US 2004/0164001 A1. These, however, have utilized expensive conversion methods for the opportunity crude, with associated higher capital expenditure and higher operating costs, and did not explore the use of delayed coking for conversion.

The prior art therefore, is limited by processing conventional crude and opportunity crude in a combined stream or train, which exposes components to corrosive crude constituents, destroying them over time.

SUMMARY OF THE INVENTION

The present invention therefore, meets the above needs and overcomes one or more deficiencies in the prior art by providing systems and methods for refining of corrosive crudes. Conventional crude and heavy, corrosive, contaminant-laden carbonaceous crude in partially separated streams or trains.

In another embodiment, the present disclosure includes a system for processing an opportunity crude, comprising: i) at least one of a pre-flash heater and an evaporator column in fluid communication with an opportunity crude line, a light material line and a heavy material line; and ii) an atmospheric crude distillation tower in fluid communication with the light material line and a conventional crude line for processing only a light material from the light material line and a conventional crude from the conventional crude line.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings, in which like elements are referenced with like numerals, wherein.

DETAILED DESCRIPTION OF THE PREFERRED EMBODIMENTS

The subject matter of the present invention is described with specificity, however, the description itself is not intended to limit the scope of the invention. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order.

The following systems and methods greatly reduce the capital and operating costs for existing petroleum refineries where the conventional crude oil feedstock will be partially replaced by a lower cost, lower quality Opportunity Crude.

Figure 1:
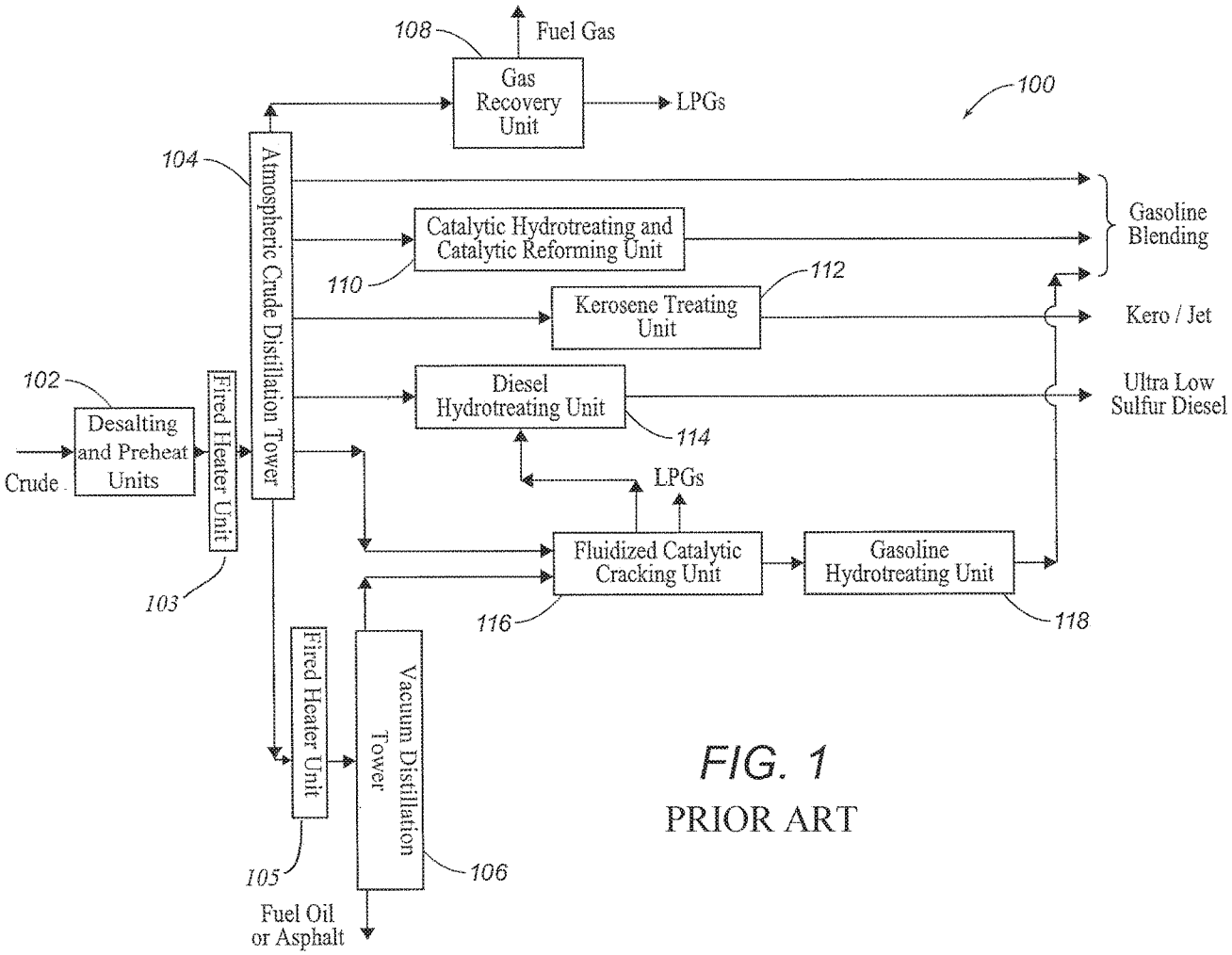
FIG. 1 PRIOR ART
FIG. 1 illustrates a conventional crude oil refining system.
Figure 2:
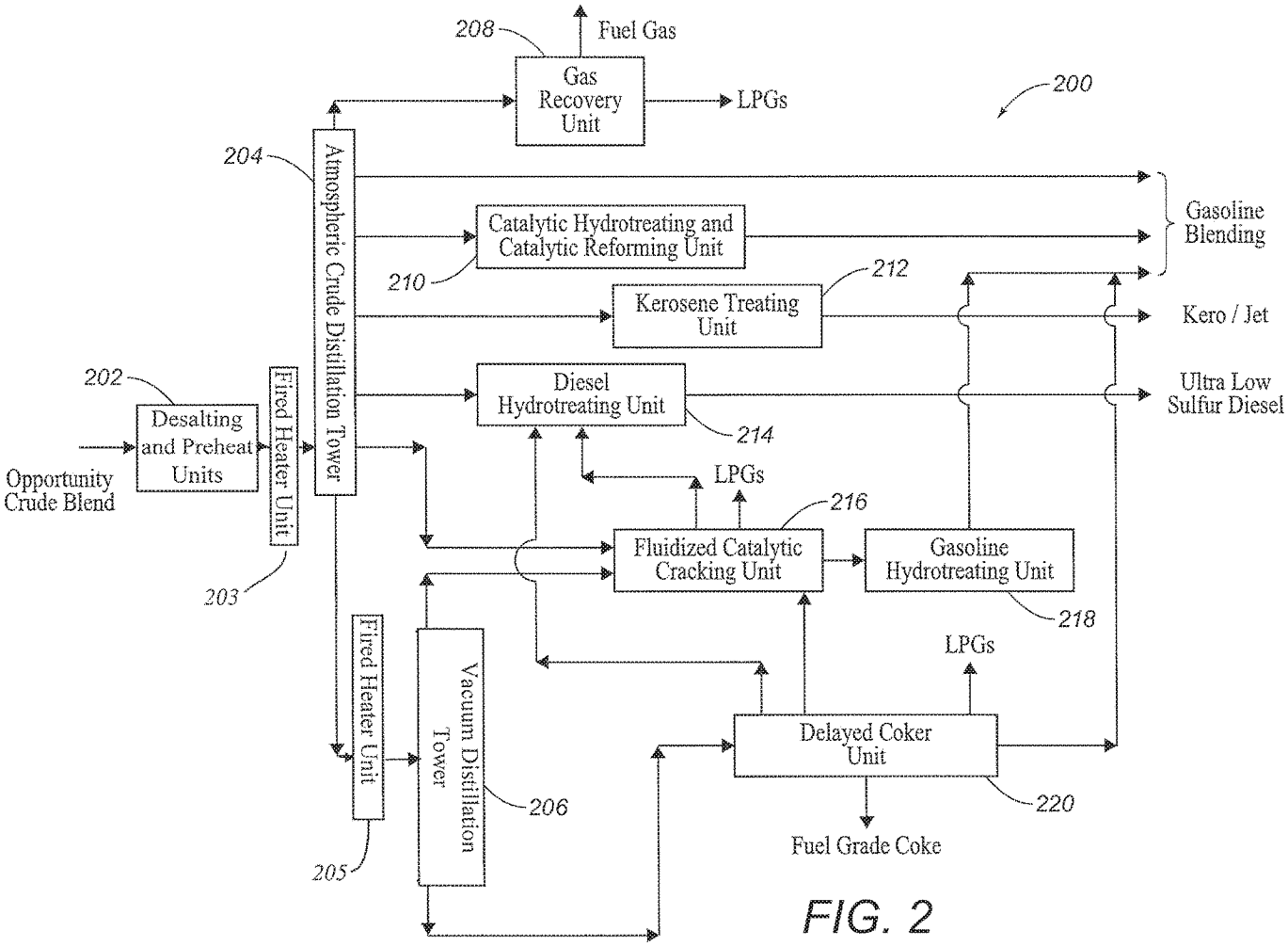
FIG. 2 PRIOR ART
FIG. 2 illustrates a prior art configuration for replacing a portion of the refinery's conventional crude with a similar volume of lower quality Opportunity Crude.
Figure 3:
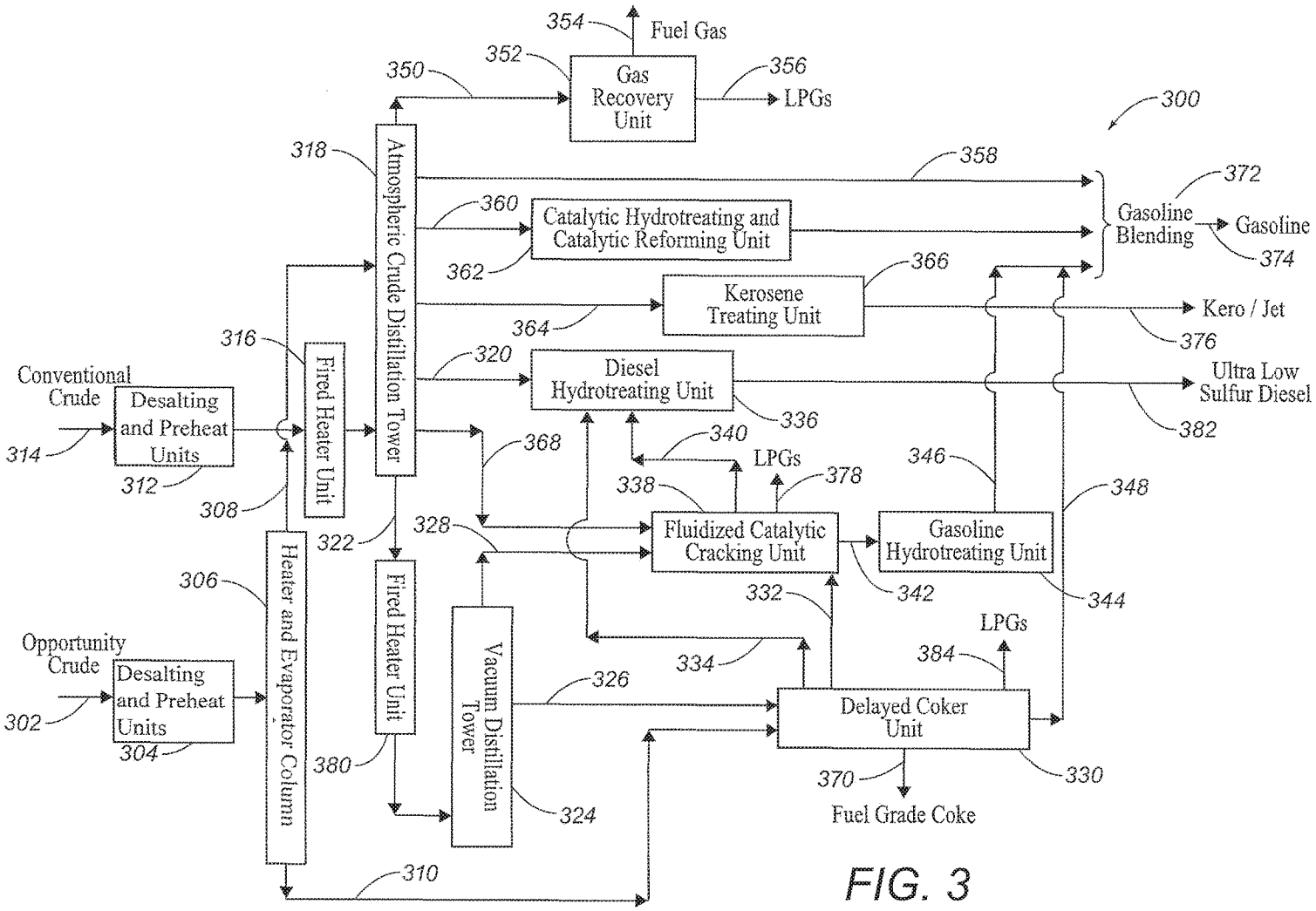
FIG. 3 illustrates one embodiment of a system for implementing the present invention.

Referring now to FIG. 3, one embodiment of a system 300 for implementing the present invention, which offers significant advantages in capital cost and construction cost, is illustrated. The system 300 achieves the cost-saving goals of replacing a portion of the refinery's conventional crude with a similar volume of lower quality Opportunity Crude and partially processing them separately by means of refinery modifications (equipment modifications and additions), which translate into both lower capital cost, lower construction cost, and a shorter construction schedule. By keeping the conventional crude in the conventional crude train as illustrated in FIG. 2, no metallurgy upgrade is necessary for most of the assets (equipment) in the system 300. In other words, partially separating the processing of conventional crude and Opportunity Crude in the system 300 eliminates the high-TAN acid crude component from some of the equipment in the system 300.

In the system 300, only conventional crude 314 is fed through the Desalting and Preheat Units 312. The volume of conventional crude 314 to be processed therefore, may be reduced and replaced by at least the same volume of Opportunity Crude 302. The optimum amount of each can vary and will be determined by refinery economics. Conventional crude 314 contains less salts, foulants and sediments than those found in Opportunity Crude 302. Therefore, by keeping the conventional crude 314 separate from the Opportunity Crude 302, existing system (i.e. equipment) may be utilized with nominal changes.

The conventional crude 314 enters Desalting and Preheat Units 312 where salts and suspended solids are removed at low temperature. This feed is preheated in a series of heat exchangers and a Fired Heater Unit 316. The Fired Heater Unit 316 is used to heat up the conventional crude 314 to a desired temperature (between 650°-700° F. depending on the type of feed) before this material is fed to an Atmospheric Crude Distillation Tower 318.

Exiting the Fired Heater Unit 316, the conventional crude 314 is flashed off in the Atmospheric Crude Distillation Tower 318, which uses pumparound cooling loops to create internal liquid reflux. Product draws are on the top, sides, and bottom of the Atmospheric Crude Distillation Tower 318. The Atmospheric Crude Distillation Tower 318 operates on a descending temperature profile from the bottom up as reflux from the top of the Atmospheric Crude Distillation Tower 318 provides the cooling medium while a fired heater in the bottom of the Atmospheric Crude Distillation Tower 318 provides heat to boil up product distillates. Light products 350 from the top of the Atmospheric Crude Distillation Tower 318 are sent to a Gas Recovery Unit 352 to separate fuel gas 354 from LPG 356.

Full range naphtha from the Atmospheric Crude Distillation Tower 318 is separated into a light fraction 358 and a heavy fraction 360. The light naphtha fraction 358 is sent for use in gasoline blending 372 to produce gasoline 374 while the heavy naphtha fraction 360 is sent to a Catalytic Hydrotreating and Catalytic Reforming Unit 362 to produce a high octane gasoline for use in gasoline blending 372 to produce gasoline 374.

A kerosene product 364 from the Atmospheric Crude Distillation Tower 318 is sent to a Kerosene Treating Unit 366 to remove sulfur and mercaptans and produce jet fuel 376. To produce jet fuel 376, a certain level of aromatic saturation must take place in order to make the smoke point specifications of jet fuel.

A diesel product 320 from the Atmospheric Crude Distillation Tower 318, light gas oil 334 from the Delayed Coker Unit 330 and a product for diesel fuel 340 from the Fluidized Catalytic Cracking unit (FCCU) 338 are sent to a Diesel Hydrotreating Unit 336 to remove sulfur and produce a diesel component 382 for Ultra Low Sulfur Diesel. The operating conditions and catalyst space velocity are therefore, selected in order to ensure both sulfur removal and a high cetane index number to meet the required specifications for the diesel component 382, which may be used for Ultra Low Sulfur Diesel. Due to the higher feed rates, the Atmospheric Crude Distillation Tower 318 may need to be modified from a conventional design using techniques well known in the art to manage the higher feed rates.

Atmospheric gas oil 368 from the Atmospheric Crude Distillation Tower 318, vacuum gas oil 328 from the Vacuum Distillation Tower 324 and heavy gas oil 332 from the Delayed Coker Unit 330 are sent to the FCCU 338 to be converted into lighter products. These products range from LPG 378, naphtha 342, to light cycle oil and slurry oil. Due to the higher feed rates, the FCCU 338 may need to be modified from a conventional design using techniques well known in the art to manage the higher feed rates. With the use of Opportunity Crude 302, heavy gas oil 332 from the Delayed Coker Unit 330 is expected to contain a higher level of contaminants requiring higher catalyst replacement.

Naphtha 342 from the FCCU 338 is sent through a Gasoline Hydrotreating Unit 344 to reduce the sulfur concentration to 10-30 ppm with minimum octane loss thus, producing a product for use in gasoline blending 372 to produce gasoline 374.

The reduced crude 322 from the bottom of the Atmospheric Crude Distillation Tower 318 is heated in a Fired Heater Unit 380 before being fed to the Vacuum Distillation Tower 324 to recover any gas oil from the reduced crude 322.

The Opportunity Crude 302 enters a Desalting and Preheat Units 304 where salts and suspended solids are removed from the oil at low temperatures and the oil is preheated in one or a series of heat exchangers. The product of the Desalting and Preheating Units 304 is then heated in the heater of the Heater and Evaporator Column 306. Due to the high acidity of this product, upgraded metallurgy may be used in areas where its temperature is greater than 450° F. with higher operating conditions anticipated for high temperature/pressure desalting. The heat exchangers of the Desalting and Preheat Units 304 and the heater of the Heater and Evaporator Column 306 may be designed for high viscosity material and may require upgraded metallurgy, which may be accessed based on specific feedstock characteristics.

The Heater and Evaporator Column 306 is used to separate condensate and remove any light material 308 with a boiling point below 650° F. (referred to as 650° F.– or low boiling Opportunity Crude), which is fed to Atmospheric Crude Distillation Tower 318. A heavy material 310 with a boiling point above 650° F. (referred to as 650° F.+ or high boiling Opportunity Crude) at the bottom of the Heater and Evaporator Column 306 is sent directly to the Delayed Coker Unit 330 to save the cost of a new alloy-lined vacuum unit. Another embodiment, however, may include a vacuum unit upstream of the Delayed Coker Unit 330. This separation point, of about 650° F. may be adjusted depending on the characteristics of the opportunity crude, including down to 600° F. or up to 750° F. However, while a higher temperature is better, as it results in the need for smaller vacuum-related components, the effects of higher temperature on the opportunity crude may be problematic, including cracking of the opportunity crude, particularly within the piping.

Vacuum resid 326 from the Vacuum Distillation Tower 324 together with the heavy material 310 are sent to the Delayed Coker Unit 330 in order to convert the vacuum resid 326 to lighter products, such as light gas oil 334, heavy gas oil 332, LPG 384, and fuel grade coke 370 while minimizing gasoline production. A dual function crude atmospheric fractionator incorporated into the Delayed Coker Unit 330 will also serve as a fractionator for coker products thus, eliminating the need for a vacuum distillation unit upstream of Delayed Coker Unit 330 as explained previously. Process operating costs can be further reduced when utilizing heat from coke drum vapor at or about 800° F. to preheat coker feed thereby, eliminating or greatly reducing the size of a separate fired heater for the dual function crude atmospheric fractionator. Thus, the atmospheric pressure flash unit operation and delayed coker product fractionation are incorporated into a single fractionation tower of the Delayed Coker Unit 330. The Delayed Coker Unit 330 may include a dual function crude atmospheric fractionator. Thus, this configuration eliminates or reduces the need for a conventional delayed coker fired heater and thus reduces the capital cost of the coker unit.

Delayed Coker Unit 330 may also include conventional gas recovery unit and naphtha hydrotreating components to produce a treated product 348 for gasoline blending, which is sent for use in gasoline blending 372 to produce gasoline 374. Distillate products (naphtha, diesel, gas oil) from the Delayed Coker 330 can be integrated with refinery hydroprocessing (hydrotreating, hydrocracking, hydro-isomerization). The Delayed Coker Unit 330 offers a shift toward higher value products such as middle distillates over gasoline. Due to special design features for Delayed Coker Unit 330, the system 300 may also focus on maximizing middle distillate production.

The system 300 may be implemented in most, if not all, existing refineries with a crude oil production capacity in the range of 50,000-200,000 barrels per stream/day although an existing refinery implementing the system 300 may, or may not, have existing resid bottoms upgrading (i.e. coking, solvent deasphalting, thermal cracking, visbreaking). By separating the Opportunity Crude 302 from the conventional crude 314 and directing the heavy material 310 and the vacuum resid 326 from the Vacuum Distillation Tower 324 to the Delayed Coker Unit 330, the system 300 avoids the need for significant equipment modifications and metallurgy upgrades in an existing refinery. The selection of Opportunity Crude type and feed rate are key evaluation factors for implementation of the system 300 to both optimize the capital cost of new equipment and minimize impacts to the existing refinery equipment (hydroprocessing, catalytic cracking, etc.). The system 300 thus, offers a low capital expenditure solution while minimizing field construction labor and downtime for the modification of existing refinery equipment. The system 300 can be implemented and applied to a modification of existing refinery assets (or equipment) with or without expansion of the refinery crude processing capacity.

The advantages of the system 300 thus, include:

combining the atmospheric pressure flash unit operation and delayed coker product fractionation functions in a single fractionation tower.

separating low quality corrosive Opportunity Crude from existing front-end processing to avoid equipment/piping modifications and metallurgy upgrades;

minimizing shutdown time and construction inefficiencies related to work in existing process units, whereby new process units can be constructed separately (green field) and tied into the existing refinery;

maximizing a middle distillates-to-gasoline ratio from bottoms upgrading to help increase refinery margins and take advantage of higher diesel and/or jet fuel demand and pricing;

integrating Opportunity Crude pre-flash and coker product fractionation to save equipment cost;

eliminating vacuum distillation required for Opportunity Crude;

using existing fuels refinery processes to manufacture finished products; and integrating the delayed coker and the separated Opportunity Crude to reduce operating costs, which i) provides significant fraction of bitumen pre-flash heat requirement (minimize pre-flash heat duty) for a superheated coke drum vapor (800° F.); and ii) refrigerates lean oil absorption to reduce coker gas recovery costs.

In the foregoing specification, the invention has been described with reference to specific embodiments thereof, and has been demonstrated as effective in providing systems and methods for lowering the processing cost of Opportunity Crude. However, it will be evident to those skilled in the art that various modifications and changes can be made thereto without departing from the broader spirit or scope of the invention. Accordingly, the specification is to be regarded in an illustrative rather than a restrictive sense. For example, it is anticipated that by routing certain streams differently or by adjusting operating parameters, different optimizations and efficiencies may be obtained, which would nevertheless not cause the system to fall outside of the scope of the present invention. It is therefore, contemplated that various alternative embodiments and modifications may be made to the disclosed embodiments without departing from the spirit and scope of the invention defined by the appended claims and equivalents thereof.

We claim:

1. A system for processing an opportunity crude, comprising:

at least one of a pre-flash heater and an evaporator column in fluid communication with an opportunity crude line, a light material line and a heavy material line; and an atmospheric crude distillation tower in fluid communication with the light material line and a conventional crude line for processing only a light material from the light material line and a conventional crude from the conventional crude line.

2. The system of claim 1, wherein the light material in the light material line and the conventional crude in the conventional crude line are processed to produce at least one of a reduced crude, a diesel product, atmospheric gas oil, a kerosene product, a light naphtha fraction, and a heavy naphtha fraction.

3. The system of claim 1, wherein the light material in the light material line comprises a carbonaceous material with a boiling point below about 650° F. and a heavy material in the heavy material line comprises a carbonaceous material with a boiling point above about 650° F.

4. The system of claim 1, wherein the light material in the light material line comprises a low boiling opportunity crude and a heavy material in the heavy material line comprises a high boiling opportunity crude.

5. The system of claim 1, further comprising:

a delayed coker in fluid communication with the heavy material line and a vacuum resid line to convert vacuum resid in the vacuum resid line into one of a light gas and a fuel grade coke product.

6. The system of claim 5, wherein a heavy material in the heavy material line is processed without vacuum distillation.

7. The system of claim 1, further comprising:

a vacuum distillation tower in fluid communication with only a reduced crude line connected to the atmospheric crude distillation tower, a vacuum gas oil line and a vacuum resid line.

8. The system of claim 7, wherein a vacuum resid in the vacuum resid line is further processed using a delayed coker to produce a treated product for gasoline blending.

* * * * *